US005221059A

United States Patent [19]

Coons, III et al.

[11] Patent Number: 5,221,059

[45] Date of Patent: Jun. 22, 1993

[54] UNIFORM YARN TENSIONING

[75] Inventors: Andrew M. Coons, III; Leonard C. Vickery, Jr., both of Anderson, S.C.

[73] Assignee: BASF Corporation, Parsippany, N.J.

[21] Appl. No.: 852,831

[22] Filed: Mar. 16, 1992

Related U.S. Application Data

[63] Continuation-in-part of Ser. No. 648,664, Jan. 30, 1991, abandoned.

[51] Int. Cl.[5] ..... B65H 59/12

[52] U.S. Cl. ..... 242/147 R; 242/42; 242/153

[58] Field of Search ..... 242/147 R, 153, 154, 242/42, 45

[56] References Cited

U.S. PATENT DOCUMENTS

| | | | |
|---|---|---|---|
| 1,884,943 | 10/1932 | Williams | 242/42 |
| 1,966,507 | 7/1934 | Langstreth | 242/42 |
| 2,095,285 | 10/1937 | Renschak | 242/153 X |
| 2,373,066 | 4/1945 | Theiler | 242/42 X |
| 2,741,150 | 4/1956 | Draudt | 242/147 R X |
| 3,010,270 | 11/1961 | Richmond et al. . | |
| 3,145,947 | 8/1964 | Stanley | 242/147 R |
| 3,191,885 | 6/1965 | Jones et al. . | |
| 3,249,312 | 5/1966 | Current | 242/42 |
| 3,317,977 | 5/1967 | Stanley | 242/147 R X |
| 3,328,947 | 7/1967 | Gibson | 242/42 X |
| 3,411,548 | 11/1968 | Pfarrwaller . | |
| 3,455,341 | 7/1969 | Pfarrwaller et al. . | |
| 3,609,835 | 10/1971 | Boon . | |
| 3,759,300 | 9/1973 | Pfarrwaller . | |
| 3,797,775 | 3/1974 | White . | |
| 3,966,133 | 6/1976 | Gelin | 242/42 |
| 4,038,811 | 8/1977 | Ansin et al. . | |
| 4,051,660 | 10/1977 | Griset, Jr. . | |
| 4,059,873 | 11/1977 | Nelson . | |
| 4,096,226 | 6/1978 | Martin et al. . | |
| 4,152,885 | 5/1979 | Cox, Jr. . | |
| 4,222,223 | 9/1980 | Nelson . | |
| 4,223,520 | 9/1980 | Whitted et al. . | |
| 4,298,172 | 11/1981 | Hellstrom . | |
| 4,313,578 | 2/1982 | Van Wilson et al. . | |
| 4,341,495 | 7/1982 | Del'Acqua . | |
| 4,343,146 | 8/1982 | Nelson . | |
| 4,351,495 | 9/1982 | Lindstrom et al. . | |
| 4,567,720 | 2/1986 | Price . | |
| 4,570,312 | 2/1986 | Whitener, Jr. . | |
| 4,571,793 | 2/1986 | Price . | |
| 4,697,317 | 10/1987 | Nelson . | |

FOREIGN PATENT DOCUMENTS

| | | | |
|---|---|---|---|
| 18077 | 11/1913 | France | 242/42 |

*Primary Examiner*—Stanley N. Gilreath

[57] ABSTRACT

An apparatus equilibrates component tensions in a multicomponent filamentary yarn which is advancing in a primary direction. The apparatus includes a series of yarn guides arranged so that the multicomponent filamentary yarn deviates both horizontally and vertically from the primary direction.

9 Claims, 2 Drawing Sheets

UNIFORM YARN TENSIONING

This is a continuation-in-part of copending application Ser. No. 07/648,664 filed on Jan. 30, 1991, now abandoned

FIELD OF THE INVENTION

This invention relates generally to fibrous synthetic polymers. More specifically, the invention relates to the production of bulked continuous filament yarn having two or more components of different colors or dye affinities.

BACKGROUND OF THE INVENTION

In the synthetic fiber industry, it is often necessary to backwind packages of bulked continuous filament yarn for additional operations, such as for air entangling multicomponent carpet yarn. When feed yarns having different colors or dye affinity, herein called "components", are backwound for air entangling, tension on the individual components affects the appearance of the final product. A low tension component will predominate because slightly more of it will be fed to the entangling point. This is especially true of crimped yarns which have an inherent springiness. U.S. Pat. No. 4,222,223 to Nelson illustrates the use of feed rate differential to create special effects. Sometimes, such as in U.S. Pat. No. 4,567,720 to Price, the feed of different components is varied at controlled time intervals to further enhance the effect.

The predominance of one component is not usually desirable. In many cases, therefore, component tensions must be accurately controlled at all times on all positions to produce uniformly combined yarn. Where tension differential allows one component to predominate, either temporarily or on one position, the yarn may produce streaks when used along with yarn produced from the same components but without tension differences. Streaks are particularly prevalent when components of contrasting colors, like red and green, are combined on multiple positions which unintentionally exhibit tension differences.

Unfortunately, tension differences are common in the backwinding operation. These differences can result from a number of factors such as creel position, friction on the running yarn at contact points, feed package size and build, physical properties such as bulk or finish level, etc. There are devices designed to address the problem of tension differential in separate yarn components. Some devices use pressure and friction. U.S. Pat. No. 3,797,775 to White discloses a device which establishes tension control by engaging the advancing filament with a rotor. The rotor is restrained from being driven by the advancing strand, thus tensioning the advancing strand. Another device making use of pressure and friction is shown in U.S. Pat. No. 4,343,146 to Nelson.

Other devices use electrical hysteresis to rectify tension differences. One such device is disclosed in U.S. Pat. No. 4,313,578 to Van Wilson et al. The Van Wilson device includes a manually adjustable tension setting tensiometer for adjusting a circuit to provide output voltages which select the tension values added to the advancing yarn.

Other devices control yarn tension by routing the yarn through a non-linear path. Exemplary is U.S. Pat. No. 3,191,885 to Jones et al. which describes a yarn tensioning device having a plurality of loops through which the yarn is threaded. The deviation of the yarn from the linear path is adjustable by pivoting an arm to which the loops are attached. Modifications on this general theme are illustrated in U.S. Pat. No. 3,010,270 to Richmond et al. and U.S. Pat. No. 4,697,317 to Nelson. Similarly, U.S. Pat. No. 3,609,835 to Boon teaches that friction may be used to provide somewhat controlled tension fluctuations.

Although the devices described above may be used to minimize tension differences between yarn components, they must be constantly monitored to guarantee tension uniformity. One reason for this is that feed yarn conditions constantly change. For example, the tension required to remove bulked continuous filament from a feed yarn package often depends on the package diameter. As the yarn is used, the package diameter continuously decreases thereby gradually continuously decreasing the tension of that component. When a full feed yarn package replaces an empty one, a discrete change in tension of the package component occurs. Even in a single position, many tension differences occur from package depletion and replacement. Other properties of individual feed yarn packages, such as density, yarn to yarn static friction due to crimp, constantly change component tensions, too.

There are devices which isolate component tension variations from the feed yarn package. For example, U.S. Pat. Nos. 3,411,548, 3,455,341, 3,759,300, all to Pfarrwaller, describe an apparatus for controlling the unwinding from a feed yarn package to isolate the tension variation at the feed yarn side. U.S. Pat. No. 4,351,495 to Lindstrom et al. describes another device which attempts to minimize tension fluctuation. U.S. Pat. No. 4,298,172 to Hellstrom describes an apparatus which enables thread to be wound onto the feed package in such a way that when unwound the variations in tension due to such unwinding are eliminated.

In addition, these feed yarn tension isolating devices can be used in combination with other tensioning devices, such as that shown in U.S. Pat. No. 3,191,885 to Jones et al., and the like. The result rather effectively eliminates multicomponent tension differences from the feed yarn package. But even the combination of devices does not compensate for other varying component properties, such as yarn bulk or finish. Furthermore, these devices are somewhat costly and typically require specialized maintenance and upkeep.

Other devices attempt to equalize component tensions by passing them together through a common tensioning device. One such device and process is shown in U.S. Pat. No. 4,570,312 to Whitener, Jr. The common device may reduce relative tension differences by increasing the tension level of all of the components. The equivalent increase causes the tension differential to be relatively less. For example, two components tensioned at 50 and 100 grams are relatively closer when increased to 550 and 600 grams tension. It is not usually desirable to operate a process at high tension levels. Overall tension increases can adversely affect a technique such as air entangling. Another drawback of such common tensioning devices is that they may magnify the effects of bulk or finish. For example, two components having different finish levels and entering the tensioning device at a uniform tension (perhaps both at 50 grams) may leave the device at 100 and 150 grams because the friction induced tension is greater on the component having less finish.

There remains a need for a manner of equalizing yarn component tensions without constant monitoring, expensive complicated hardware or excessive overall tension increases.

SUMMARY OF THE INVENTION

Accordingly, the present invention is an apparatus for equilibrating component tensions in a multicomponent filamentary yarn which is advancing in a primary linear direction comprising a series of at least four yarn guides having yarn advancing sequentially therethrough. At least two of the guides define a primary linear direction and remaining guides are positioned relative to the primary direction to deviate yarn away from the primary direction in at least two planes wherein the advancing yarn, during advancement, is not contained in a single plane.

A second embodiment of the invention involves a method for equilibrating the component tension of a multicomponent filamentary yarn by advancing the yarn in a primary direction and deviating the yarn in two directions from the primary direction so that the advancing yarn is not contained in a single plane.

It is an object of the present invention to provide an improved tensioning apparatus and method.

Related objects and advantages will be apparent to one ordinarily skilled in the relevant art after reviewing the following description.

DESCRIPTION OF THE PREFERRED EMBODIMENTS

For the purposes of promoting an understanding of the principles of the invention, reference will now be made to specific embodiments of the invention and specific language which will be used to describe the same. It will nevertheless be understood that no limitation of the scope of the invention is thereby intended, such alterations and further modifications, and such further applications of the principles of the invention as discussed are contemplated as would normally occur to one skilled in the art to which the invention relates.

A first embodiment of the present invention is an apparatus for preventing the predominance of one component in an air entangled yarn made from two or more different colored or different dye affinity bulked continuous filament feed yarns without unsuitably increasing the overall tension. The apparatus exploits the surprising discovery that components themselves, with appropriate manipulations, can be used cooperatively to equalize tensions. One aspect of this discovery guides the components to run nearly immediately on top of each other so that they travel in unison.

Figure 1:
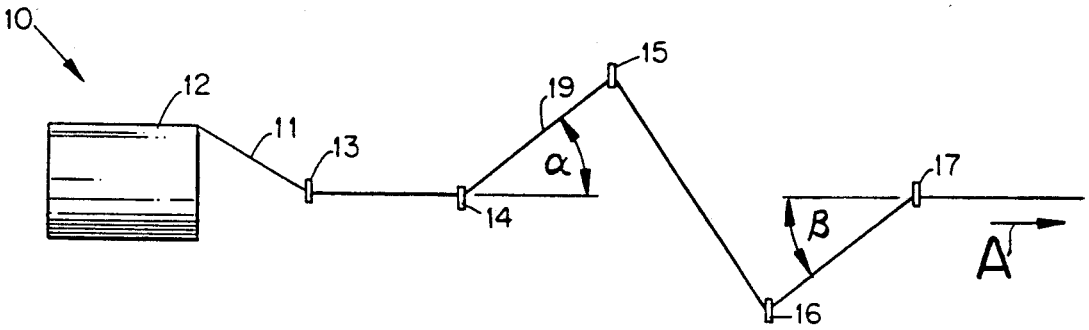
FIG. 1 is a schematic top view of an arrangement to equalize tensions of individual yarn components according to the present invention.

FIG. 1 shows an apparatus 10 which includes a number of yarn guides for congregating separate yarn components and then traversing them through a multi-planar path. The guides are arranged to deviate the yarn pathway from linear in at least two different planes. The action produced from this traversal causes the individual tension forces to equilibrate.

In FIG. 1, component 11 is withdrawn from package 12 in the direction of the arrow A. This direction is herein called the primary yarn direction which is defined by the linear axis connecting guides 14 and 17. The yarn path has two directional displacements. One displacement is in the horizontal plane shown in FIG. 1. The second displacement is in the vertical plane shown in FIG. 2. Yarn 11 is then moved through a first guide 13, for example, a ceramic eyelet, and on through an arrangement of guides that accomplishes the present objectives. Guides 14, 15, 16 and 17 are so arranged. In the horizontal plane of FIG. 1, guide 14 is positioned nearly linearly with guide 13 and acts as the congregating point where all components, including component 11, first come together to form multicomponent yarn 19. This congregating function will be described more particularly in connection with FIG. 2. Multicomponent yarn 19 then moves to guide 15 which is horizontally displaced in a first direction from the primary yarn direction. Next, multicomponent yarn 19 passes to guide 16 which is horizontally displaced in a second direction from the primary yarn direction. Then, according to the illustration, multicomponent yarn 19 returns to the primary yarn direction through guide 17. Horizontal deviation angles $\alpha$ and $\beta$ are between about 1° and 179° from the primary yarn direction.

Figure 2:
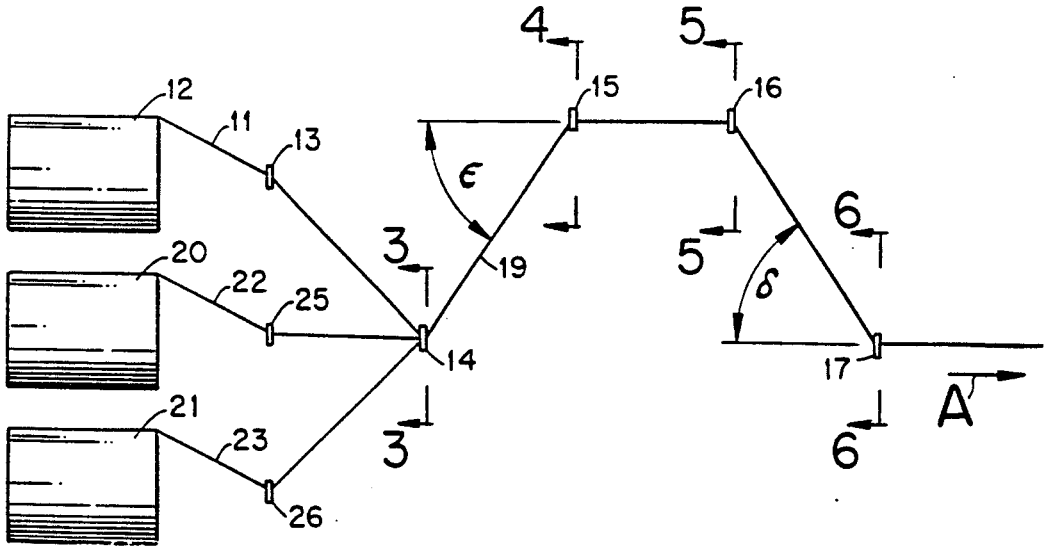
FIG. 2 is a schematic side view of the arrangement of FIG. 1.
Figure 3:
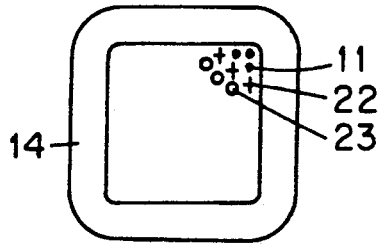
FIG. 3 is a schematic of a cross section through a first multicomponent yarn position, taken along line 3—3 of FIG. 2 and looking in the direction of the arrows.
Figure 4:
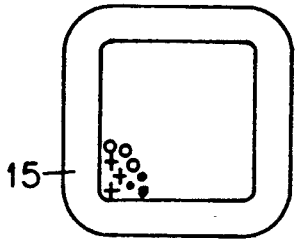
FIG. 4 is a schematic of a cross section through a second multicomponent yarn position, taken along line 4—4 of FIG. 2 and looking in the direction of the arrows.
Figure 5:
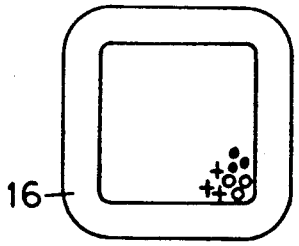
FIG. 5 is a schematic of a cross section through a third yarn position, taken along line 5—5 of FIG. 2 and looking in the direction of the arrows.
Figure 6:
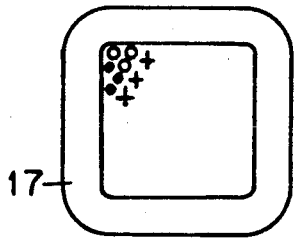
FIG. 6 is a schematic of a cross section through a fourth yarn position, taken along line 6—6 of FIG. 2 and looking in the direction of the arrows.

FIG. 2 is a schematic side view of the apparatus of FIG. 1. In the illustration 3 yarn packages, 12, 20, 21, are shown in approximately vertical alignment. It will be recognized that these packages might also be arranged horizontally or in some other fashion. In addition, there may be more or less packages according to the number of components in the desired final product. Returning to the arrangement depicted, component yarns 11, 22 and 23 are withdrawn from packages 12, 20 and 21, respectively. Each withdrawn component passes through a first guide and then on to the congregation point at guide 14. Component 11 passes through guide 13. Component 22 passes through guide 25. Component 23 passes through guide 26.

After congregation at guide 14, multicomponent yarn 19 continues to guide 15 which deviates vertically from the primary yarn direction. Next, multicomponent yarn 19 moves through guide 16 which is shown at approximately at the same vertical direction as guide 15. Then, the yarn returns to the primary yarn direction by passing through guide 17. In FIG. 2, vertical deviation angles $\epsilon$ and $\delta$ are approximately 30°. Any angle between about 1° and about 179° may be used to accomplish the objective.

The positions represented by guides 14, 15, 16 and 17 are illustrated in FIGS. 3 through 6, respectively. The views represented by FIG. 3 through FIG. 6, are taken along the corresponding lines of FIG. 2 and looking in the direction of the arrows. As shown, component yarn 11 is represented by a solid round cross section. Component yarn 22 is represented by a, cross-shaped cross section. Component yarn 23 is represented by a hollow round cross section. These figures show how guiding multicomponent yarn 19 through multi-planar path deviations transfers force from higher tension components to lower tension components by alternating which component is on the inside through a curve. The end result is that all components of the multicomponent yarn continue beyond guide 17 to a processing apparatus (like and air entangling apparatus) under approximately uniform tension.

Yarn deviation angles should be such that the components travel through the yarn pathway in unison. Yarn deviation angles of1°-30° are presently preferably as it is believed that the large angles create excessive tension increases. But as noted above, yarn angles of 1°-179° equalize component tensions and provide acceptable results. A variety of guide designs are useful with the present invention. Exemplary useful guides are four-sided ceramic eyelets. One factor in selecting a guide is that its design should keep the components together rather than allowing them to spread out. Also, low surface friction guides or roller bearings can further reduce total tension increase without affecting the tension equalizing ability of the invention.

The apparatus of the present invention is useful in a variety or process. For example, the invention is useful in an air entangling operation such as described in U.S. Pat. No. 4,223,520 Whitted, U.S. Pat. No. 4,152,885 to Cox, Jr. and U.S. Pat. No. 4,051,660 to Griset, Jr. or those commercially available from Gilbos, Belmont, Pritchett, or Poinsett where feed yarns are creeled as individual packages. The yarn is pulled from the packages in the creel by the air entangling process causing differences in feed yarn tensions. The apparatus of the present invention placed just after the creel can significantly improve the color uniformity of the product resulting from these air entangling operations.

The present invention is also useful with air jet texturing operations, such as U.S. Pat. No. 4,571,793 to Price, U.S. Pat. No. 4,038,811 to Ansin, U.S. Pat. No. 4,059,873 to Nelson or many commercially available from Eltex, Enterprise, Barmag or Murata, when it is desired to feed two or more components at the same rate. Three feed yarns are shown being fed at the same rates in the patents to Ansin and to Nelson. Maintaining equal tensions is essential to feeding these components at the same rate, particularly if the yarn has been previously crimped. The invention herein disclosed if the yarn has been previously crimped. The invention herein disclosed can equalize tensions when placed, for example, between the feed yarn packages and the texturing operation.

Presently it is believed that yarn tensions in at least a range of about 10 to about 1,000 grams may be equalized to within about 10% variation. Further enhancement and equalization outside this range is contemplated.

The invention is further exemplified by the examples below, which are presented to illustrate certain specific embodiments of the invention, but are not intended to be constructed so as to restrict the spirit and scope thereof.

EXAMPLE 1

Two 1,000 denier yarns fed at 50 and 200 grams, respectively, are combined using the guide arrangement described above to a single end at about 300 grams. Separated after combination the individual tensions are 150+7.5 (+5%) grams.

EXAMPLE 2

Using a Gilbos IDS-6 machine and the creel provided with it, guides are arranged in the manner disclosed herein over the service walkway between the creel and machine. The guides are four-sided ceramic with a polished surface and a square ¼" eyelet. Each of four yarn angles, $\alpha$, $\beta$, $\epsilon$, and $\delta$ are about 60°. Three crimped, continuous filament, nylon 6 1,115 denier trilobal precolored yarns (red, green, gray) are combined on the apparatus. Gilbos operation speed is 600 ypm with 130 psig air pressure through an IMS ½" jet. Two sample multicomponent yarns are prepared. The initial component tensions for red, green and gray are as indicated for samples C and D in Table 1 below. The resulting multicomponent yarn is tufted into carpet. The CIE L*a*b E value of each carpet is determined.

Two other multifilamentary yarn samples are prepared as above except that these two samples are not fed through the guiding arrangement of the present invention.

The tensions are as shown for A and B in Table 1 below.

Carpets prepared from samples A and B are dramatically (8-10 E CIE L*a*b color units) different in appearance when compared to each other. The low tension component predominates resulting in packages that streak severely when used together in a carpet. Carpets prepared from samples C and D appear the same (0-2 E CIE L*a*b color units) in appearance.

TABLE 1

| Sample | A | B | C | D |
|---|---|---|---|---|
| Red creel tension | 200 g | 50 g | 200 g | 50 g |
| Green creel tension | 50 g | 200 g | 50 g | 200 g |
| Gray creel tension | 100 g | 100 g | 100 g | 100 g |
| Combined tension | 400 g | 400 g | 400 g | 400 g |
| Special guiding | No | No | Yes | Yes |
| Combined appearance | Green | Red | Gr/Red | Gr/Red |

What is claimed is:

1. An apparatus for equilibrating component tensions in a multicomponent filamentary yarn which is advancing in a primary linear direction, comprising:

a series of at least four yarn guides each having a yarn contacting surface and having said multicomponent yarn advancing sequentially therethrough in a yarn path from a first guide to a last guide, said first guide and said last guide defining said primary linear direction and remaining guides positioned relative to said primary direction to deviate said yarn away from said primary direction in at least two planes such that said yarn path from said first guide to said last guide is not contained in a single plane and one of said components contacts each yarn contacting surface and the component contacting said yarn contacting surface alternates from guide to guide.

2. The apparatus of claim 1 wherein said series is a series of only four which prevent the advancing yarn from being contained in any one plane.

3. The apparatus of claim 1 wherein each guide defines a yarn contacting surface having corners.

4. The apparatus of claim 1 wherein the deviation caused by said guides defines an angle of between 1° and 179°.

5. The apparatus of claim 1 wherein each said angle of deviation is between 1° and 30°.

6. A method for equilibrating the component tension of a multicomponent filamentary yarn, comprising:

advancing the multicomponent yarn in a primary direction;

deviating the yarn in at least two directions from the primary direction so that tension on each component after said deviating is substantially equal;

accomplishing said deviating by directing the multicomponent yarn through a series of yarn guides;

engaging the yarn with a yarn contacting surface of each yarn guide, the yarn contacting surface of each yarn guide causing an angle of deviation of the yarn from the primary direction; and, alternating which component contacts the yarn contacting surface of a respective yarn guide as the yarn is directed through the series of yarn guides.

7. The method of claim 6 wherein each angle of deviation is between 1° and 179°.

8. The method of claim 6 wherein each angle of deviation is between 1° and 30°.

9. A method for equalizing the tension on multicomponent yarn comprising:

(a) guiding the multicomponent yarn through a series of guides to cause multiple angular path deviations which transfer force from higher tension components to lower tension components;

(b) during said guiding, engaging the yarn with each guide such that one yarn component contacts the guide through an angular path deviation and (c) alternating which component is engaged during an angular path deviation.

* * * * *